US010801484B2

(12) United States Patent
Lee et al.

(10) Patent No.: US 10,801,484 B2
(45) Date of Patent: Oct. 13, 2020

(54) HERMETIC COMPRESSOR

(71) Applicant: Samsung Electronics Co., Ltd., Suwon-si, Gyeonggi-do (KR)

(72) Inventors: Jeong-bae Lee, Hwaseong-si (KR); Ki-chul Song, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 15/993,444

(22) Filed: May 30, 2018

(65) Prior Publication Data

US 2019/0024650 A1 Jan. 24, 2019

(30) Foreign Application Priority Data

Jul. 19, 2017 (KR) ..... 10-2017-0091703

(51) Int. Cl.
*F04B 39/02* (2006.01)
*F04C 29/02* (2006.01)
(Continued)

(52) U.S. Cl.
CPC ..... *F04B 39/0246* (2013.01); *F04B 35/04* (2013.01); *F04C 18/0215* (2013.01);
(Continued)

(58) Field of Classification Search
CPC ..... F04B 39/023; F04B 39/0238; F04B 39/0246; F04B 39/0261; F04C 29/02;
(Continued)

(56) References Cited

U.S. PATENT DOCUMENTS 5,322,419 A * 6/1994 Novolan ..... F04B 39/0072 184/6.18
6,450,785 B1 * 9/2002 Dellby ..... F04B 39/0261 184/6.16
(Continued)

FOREIGN PATENT DOCUMENTS

EP 0815360 A1 1/1998
EP 1605163 A1 12/2005
(Continued)

OTHER PUBLICATIONS

International Search Report dated Nov. 23, 2018 in connection with International Patent Application No. PCT/KR2018/007211, 3 pages.
(Continued)

*Primary Examiner* — Philip E Stimpert

(57) ABSTRACT

A hermetic compressor includes an airtight case a lower portion of which oil is stored in; a frame received in the airtight case; a compression mechanism disposed in the frame and to compress a refrigerant; a motor mechanism including a stator fixed to the frame and a rotor to rotate inside the stator; a rotation shaft coupled to the rotor and provided with a cavity at a lower portion of the rotation shaft, wherein the rotation shaft rotates together with the rotor and operates the compression mechanism; a stationary shaft inserted into the cavity of the rotation shaft, fixed to the airtight case, and provided with a helical groove formed on an outer circumferential surface; and an oil raising member fixed to the cavity of the rotation shaft and configured to surround the stationary shaft. The oil raising member raises the oil stored in the airtight case.

20 Claims, 24 Drawing Sheets

(51) Int. Cl.

| | |
|---|---|
| ***F04C 23/00*** | (2006.01) |
| ***F04B 35/04*** | (2006.01) |
| ***F04C 18/02*** | (2006.01) |

(52) U.S. Cl.
CPC ..... *F04C 23/008* (2013.01); *F04C 29/023* (2013.01); *F04C 29/025* (2013.01); *F04C 2240/40* (2013.01); *F04C 2240/603* (2013.01)

(58) Field of Classification Search
CPC ..... F04C 29/023; F04C 29/025; F04C 2240/603; F04D 1/12; F04D 1/14; F04D 23/001; F04D 23/005
See application file for complete search history.

(56) References Cited

U.S. PATENT DOCUMENTS

| | | | | |
|---|---|---|---|---|
| 2005/0115771 | A1 | 6/2005 | Shin | |
| 2010/0074771 | A1 | 3/2010 | Klein et al. | |
| 2010/0233003 | A1* | 9/2010 | Silva | F04B 39/123 418/83 |
| 2013/0309119 | A1 | 11/2013 | Kim | |

FOREIGN PATENT DOCUMENTS

| | | | |
|---|---|---|---|
| EP | 3159539 | A1 | 4/2017 |
| JP | 2005-180367 | A | 7/2005 |
| JP | 3910600 | B2 | 4/2007 |
| JP | 20120149532 | A | 8/2012 |
| JP | 2014-092120 | A | 5/2014 |
| JP | 2015-094223 | A | 5/2015 |
| KR | 10-0226408 | B1 | 10/1999 |
| KR | 10-0407960 | B1 | 12/2003 |
| KR | 10-0533047 | B1 | 12/2005 |
| KR | 10-2009-0079965 | A | 7/2009 |
| KR | 10-1483519 | B1 | 1/2015 |
| KR | 10-2015-0021443 | A | 3/2015 |
| WO | 9629516 | A1 | 9/1996 |
| WO | 2008052297 | A1 | 5/2008 |
| WO | 2016192974 | A1 | 12/2016 |

OTHER PUBLICATIONS

Written Opinion of the International Searching Authority dated Nov. 23, 2018 in connection with International Patent Application No. PCT/KR2018/007211, 7 pages.
Supplementary European Search Report in connection with European Application No. EP 18835753.7 dated Apr. 30, 2020, 8 pages.

* cited by examiner

HERMETIC COMPRESSOR

CROSS-REFERENCE TO RELATED APPLICATION AND CLAIM OF PRIORITY

This application is based on and claims priority under 35 U.S.C. § 119 to Korean Patent Application No. 10-2017-0091703 filed Jul. 19, 2017 in the Korean Intellectual Property Office, the disclosure of which is incorporated herein by reference in its entirety.

TECHNICAL FIELD

The present disclosure relates to a hermetic compressor, and more particularly, to a lubrication structure of a hermetic compressor.

BACKGROUND

Generally, a compressor is one of components constituting a refrigeration cycle apparatus, and is a device that compresses a refrigerant at a high temperature and a high pressure and delivers the compressed refrigerant to a condenser.

Compressors may be classified into various types according to compression type and sealing structure. For example, hermetic compressors may be classified into a reciprocating compressor, a scroll compressor, a rotary compressor, and the like. Such a hermetic compressor may include a compression mechanism for compressing refrigerant and a motor mechanism for driving the compression mechanism.

For example, a hermetic reciprocating compressor includes a compression mechanism configured to compress the refrigerant through the reciprocating motion of a piston, and a motor mechanism configured to drive the piston of the compression mechanism. The compression mechanism and the motor mechanism are disposed inside an airtight case.

Such a hermetic reciprocating compressor includes a rotation shaft for transmitting the driving force of the motor mechanism to the compression mechanism. The lower portion of the airtight case is provided with an oil reservoir in which oil or lubricant for lubricating and cooling components of the compressor is stored. The rotation shaft is provided with an oil supply structure for raising and supplying the oil or lubricant stored in the oil reservoir to the respective components. Therefore, when the rotation shaft rotates, the oil in the oil reservoir is supplied to the respective components of the compressor through the oil supply structure of the rotation shaft.

An inner passage for raising the oil in the oil reservoir is formed in the inside of the rotation shaft, and a helical groove through which oil flows is provided on the outer circumferential surface of the upper portion of the rotation shaft.

The oil in the oil reservoir of the lower portion of the airtight case is raised through the inner passage formed inside the rotation shaft, guided to the helical groove formed on the outer circumferential surface of the rotation shaft, and then supplied to the bearing for supporting the rotation of the rotation shaft, thereby lubricating and cooling the bearing.

At this time, since the oil is supplied by the centrifugal force of the rotation shaft, the oil supply is reduced when the rotational speed of the rotation shaft is lowered.

Such a hermetic reciprocating compressor is widely used in refrigerators. However, recently, the compressors are required to operate at a lower speed in order to improve energy efficiency of the refrigerators.

In this case, the conventional oil supply method in which the oil supply amount is determined in proportion to the rotational speed has a limitation in lowering the speed of the compressor. Therefore, a new oil supply method is needed.

An example of a compressor in which a conventional oil supply system is improved is disclosed in Korean Patent Publication No. 10-2013-0127640. According to the above patent, a spiral protrusion or a fixing protrusion provided with a spring is disposed inside the rotation shaft, and oil is raised by the viscous force of the oil and the rotation of the rotation shaft. Therefore, the rotational speed of the compressor may be lowered compared with the conventional compressor.

However, such an oil supply structure also has a problem that the rotational speed cannot be lowered to the rotational speed of the compressor required for high efficiency of the refrigerator in recent years. Therefore, there is a demand for an oil supply structure of a hermetic compressor capable of lowering the rotational speed of the compressor lower than that of the conventional compressor.

SUMMARY

The present disclosure has been developed in order to overcome the above drawbacks and other problems associated with the conventional arrangement. An aspect of the present disclosure relates to a hermetic compressor that can supply oil to rotating components of the hermetic compressor even when operated at a low rotational speed to expand an operating range of the hermetic compressor required for high efficiency of a refrigerator.

In accordance with an aspect of the present disclosure, a hermetic compressor may include an airtight case a lower portion of which oil is stored in; a frame received in the airtight case; a compression mechanism disposed in the frame and configured to compress a refrigerant; a motor mechanism including a stator fixed to the frame and a rotor configured to rotate inside the stator; a rotation shaft coupled to the rotor and provided with a cavity at a lower portion of the rotation shaft, wherein the rotation shaft rotates together with the rotor and operates the compression mechanism; a stationary shaft inserted into the cavity of the rotation shaft, fixed to the airtight case, and provided with a helical groove formed on an outer circumferential surface of the stationary shaft; and an oil raising member fixed to the cavity of the rotation shaft and configured to surround the stationary shaft, wherein the oil raising member may rotate integrally with the rotation shaft, move relative to the stationary shaft, and raise the oil stored in the lower portion of the airtight case.

The oil raising member may be formed in a hollow cylindrical shape, and a plurality of protrusions or a plurality of grooves may be provided on a surface of the oil raising member facing the stationary shaft.

The oil raising member may be formed in a hollow cylindrical shape, and a helical groove or a helical protrusion may be provided on a surface of the oil raising member facing the stationary shaft.

A surface of the oil raising member facing the stationary shaft may have a surface roughness capable of maximizing a drag force for raising the oil.

At least two extending protrusions having a length corresponding to a length of the oil raising member may be provided on a surface of the oil raising member facing the cavity of the rotation shaft in a longitudinal direction of the oil raising member.

The oil raising member may be formed in a hollow pipe shape having a cross-section of a lobe shape.

The oil raising member may be formed by bending an elastic sheet into a cylindrical shape.

In accordance with another aspect of the present disclosure, a hermetic compressor may include an airtight case a lower portion of which oil is stored in; a frame received in the airtight case; a compression mechanism disposed in the frame and configured to compress a refrigerant; a motor mechanism including a stator fixed to the frame and a rotor configured to rotate inside the stator; a rotation shaft coupled to the rotor and provided with a cavity at a lower portion of the rotation shaft, wherein the rotation shaft rotates together with the rotor and operates the compression mechanism; a stationary shaft inserted into the cavity of the rotation shaft and fixed to the airtight case; and an oil raising member fixed to the cavity of the rotation shaft, configured to surround the stationary shaft, and provided with a helical groove on a surface of the oil raising member facing the stationary shaft, wherein the oil raising member may rotate integrally with the rotation shaft, move relative to the stationary shaft, and raise the oil stored in the lower portion of the airtight case.

The stationary shaft may be formed in a cylindrical shape, and a plurality of protrusions or a plurality of grooves may be provided on an outer circumferential surface of the stationary shaft.

The stationary shaft may be formed in a columnar shape having a cross-section of a lobe shape.

The compression mechanism may include a cylinder fixed to the frame and a piston connected to the rotation shaft and configured to reciprocate inside the cylinder.

The compression mechanism may include a fixed scroll fixed to the frame and an orbiting scroll connected to the rotation shaft and configured to rotate with respect to the fixed scroll.

Other objects, advantages and salient features of the present disclosure will become apparent from the following detailed description, which, taken in conjunction with the annexed drawings, discloses various embodiments.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects, features, and advantages of certain embodiments of the present disclosure will be more apparent from the following description taken in conjunction with the accompanying drawings, in which.

Throughout the drawings, like reference numerals will be understood to refer to like parts, components and structures.

DETAILED DESCRIPTION

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, certain embodiments of the present disclosure will be described in detail with reference to the accompanying drawings.

The matters defined herein, such as a detailed construction and elements thereof, are provided to assist in a comprehensive understanding of this description. Thus, it is apparent that various embodiments may be carried out without those defined matters. Also, well-known functions or constructions are omitted to provide a clear and concise description of various embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe various embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1:
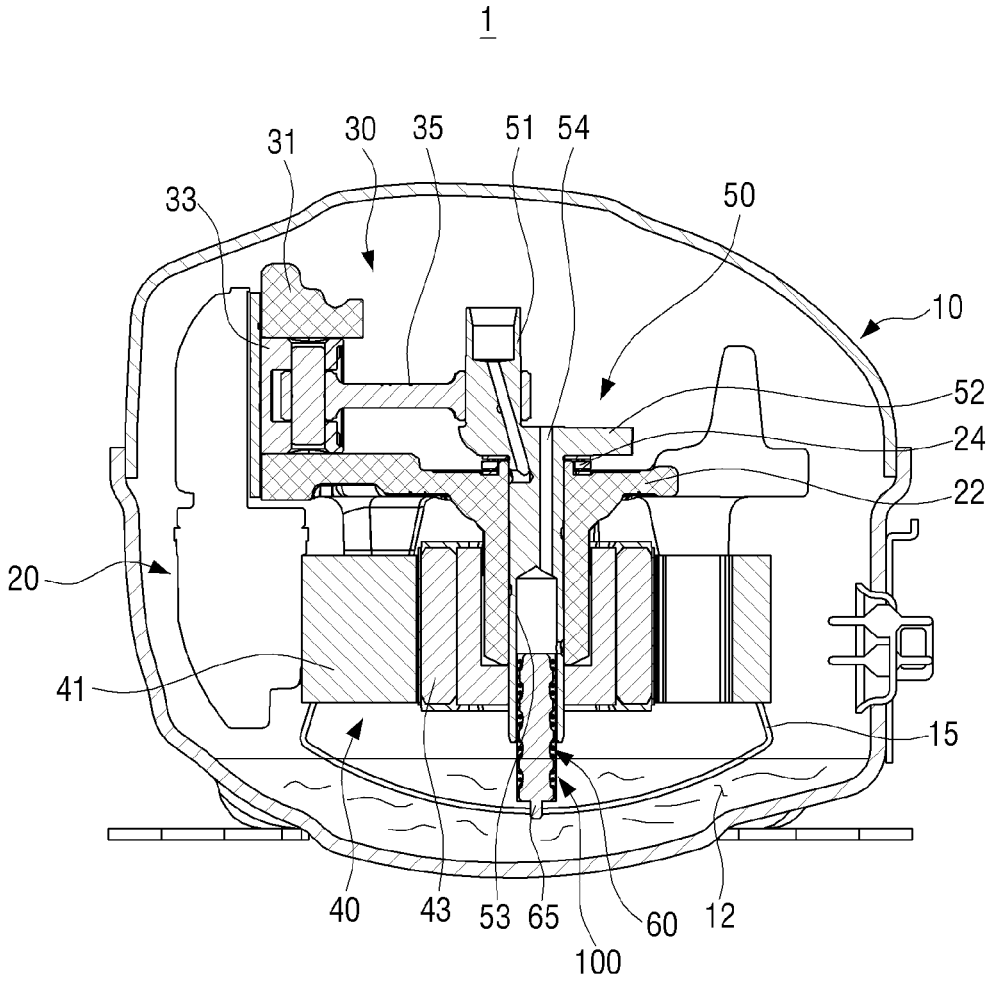
FIG. 1 is a longitudinal sectional view illustrating a hermetic compressor according to an embodiment.
Figure 2:
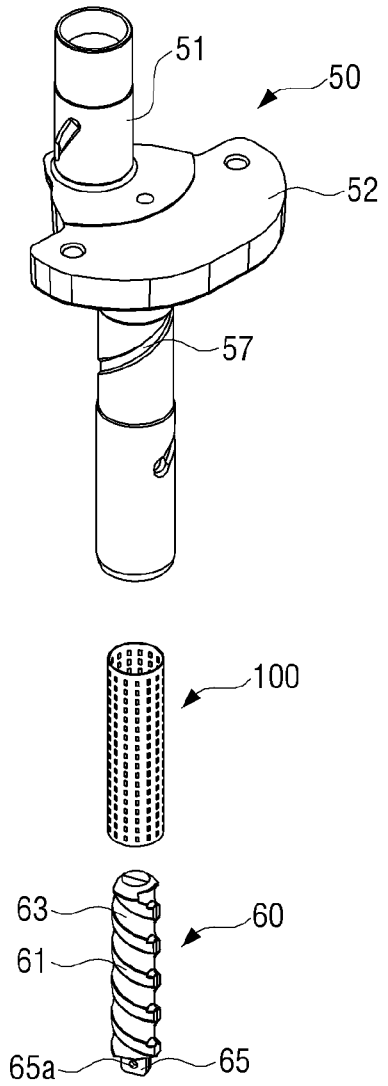
FIG. 2 is an exploded perspective view illustrating a rotation shaft, a stationary shaft, and an oil raising member of the hermetic compressor of FIG. 1.
Figure 3:
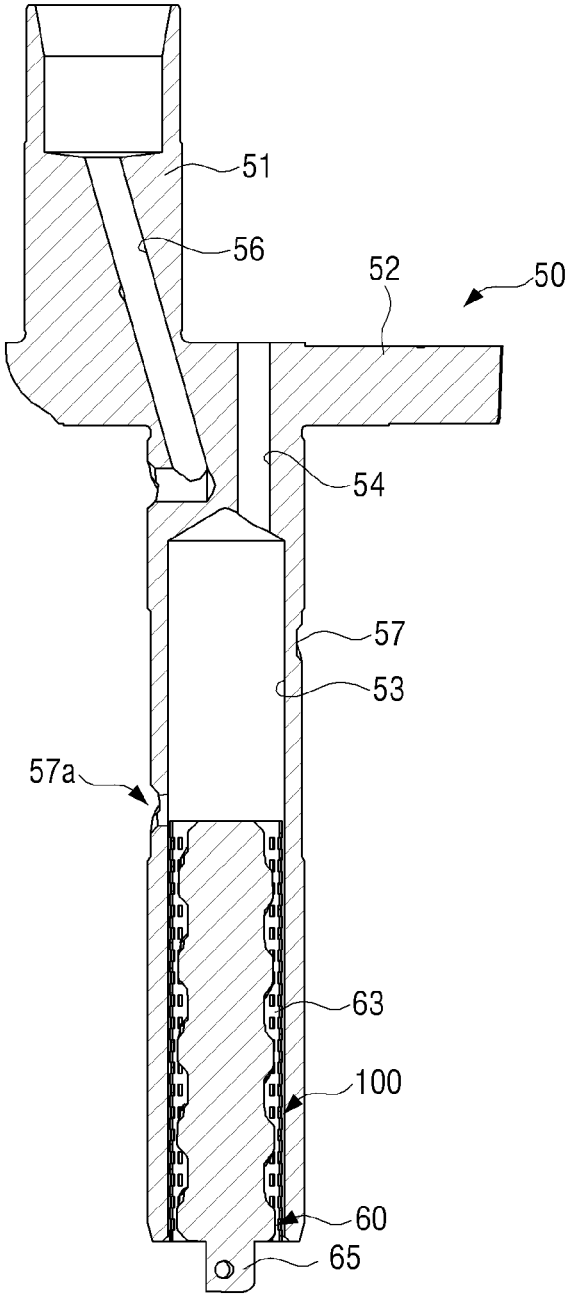
FIG. 3 is a longitudinal sectional view illustrating a state in which the rotation shaft, the stationary shaft, and the oil raising member of the hermetic compressor of FIG. 1 are assembled.

FIG. 1 is a longitudinal sectional view illustrating a hermetic compressor according to an embodiment. FIG. 2 is an exploded perspective view illustrating a rotation shaft, a stationary shaft, and an oil raising member of the hermetic compressor of FIG. 1. FIG. 3 is a longitudinal sectional view illustrating a state in which the rotation shaft, the stationary shaft, and the oil raising member of the hermetic compressor of FIG. 1 are assembled.

Referring to FIGS. 1 to 3, a hermetic compressor 1 according to an embodiment of the present disclosure may include an airtight case 10, a frame 20, a compression mechanism 30, a motor mechanism 40, a rotation shaft 50, a stationary shaft 60, and an oil raising member 100.

The airtight case 10 forms an outer appearance of the hermetic compressor 1. The frame 20, the compression mechanism 30, the motor mechanism 40, the rotation shaft 50, the stationary shaft 60, and the oil raising member 100 are provided inside the airtight case 10. The airtight case 10 is provided with an inlet and an outlet through which a refrigerant enters and exits. The lower portion of the airtight case 10 may be provided with an oil reservoir 12 in which oil or lubricant (hereinafter referred to as oil) for lubricating and cooling various components of the hermetic compressor 1 is stored.

The frame 20 is fixed to the inside of the airtight case 10 and fixes or supports various components inside the airtight case 10.

The compression mechanism 30 is provided at the upper side of the frame 20 and compresses the refrigerant. The compression mechanism 30 may be implemented in various ways such as a reciprocating manner, a scroll manner, or the like. The compression mechanism 30 illustrated in FIG. 1 shows a case where the compression mechanism 30 is implemented in a reciprocating manner. Hereinafter, the case where the compression mechanism 30 is of the reciprocating type will be described as an example. The refrigerant compressed in the compression mechanism 30 is discharged to the outside of the airtight case 10 through the outlet.

The compression mechanism 30 may include a cylinder 31 that forms a compression space for the refrigerant and is fixed to the frame 20 and a piston 33 linearly reciprocating inside the cylinder 31 and compressing the refrigerant.

The motor mechanism 40 generates a driving force for driving the compression mechanism 30 and is provided below the frame 20. The motor mechanism 40 may include a stator 41 fixed to the frame 20 and a rotor 43 that is rotated inside the stator 41. The rotor 43 is provided at the center thereof with a through hole through which the rotation shaft 50 is fixed. The rotation shaft 50 is disposed in the through hole of the rotor 43 and may rotate integrally with the rotor 43.

The rotation shaft 50 is provided to transmit the rotational force of the motor mechanism 40 to the compression mechanism 30. In other words, the rotation shaft 50 is connected to the rotor 43 of the motor mechanism 40 and rotates together with the rotor 43 to operate the compression mechanism 30. The rotation shaft 50 is rotatably supported by a shaft supporter 22 fixed to the frame 20.

The rotation shaft 50 may include an eccentric part 51 provided at an upper portion of the rotation shaft 50 and a cavity 53 provided at a lower portion thereof.

The eccentric part 51 is formed to be eccentric with respect to the rotational center axis of the rotation shaft 50. The eccentric part 51 is connected to the piston 33 of the compression mechanism 30 by a connecting rod 35. Therefore, when the rotation shaft 50 rotates, the piston 33 may reciprocate linearly with respect to the cylinder 31. In other words, the rotary motion of the rotation shaft 50 may be converted into the linear reciprocating motion of the piston 33 by the eccentric part 51 of the rotation shaft 50 and the connecting rod 35.

A disc part 52 extending in the radial direction may be formed at a lower portion of the eccentric part 51. A bearing 24 for supporting the rotation of the rotation shaft 50 and the axial load of the rotation shaft 50 may be provided between the disc part 52 and the shaft supporter 22. For example, a thrust bearing 24 may be provided between the disc part 52 and the top surface of the shaft supporter 22.

The cavity 53 provided at the lower portion of the rotation shaft 50 is formed to raise the oil stored in the oil reservoir 12 of the airtight case 10. The cavity 53 is formed in a circular cross-section and is formed to have a predetermined depth from the bottom end of the rotation shaft 50. The depth or length of the cavity 53 may be variously determined. For example, as illustrated in FIG. 1, the cavity 53 may be formed to have a length of about ½ of the length under the disc part 52 of the rotation shaft 50. As another example, the cavity 53 may be formed such that the top end of the cavity 53 is adjacent to the disc part 52 of the rotation shaft 50 as illustrated in FIG. 3.

The rotation shaft 50 is provided with a first oil passage 54 for communicating the top surface of the disc part 52 and the cavity 53. Therefore, oil supplied through the cavity 53 is discharged to the upper portion of the rotation shaft 50 through the first oil passage 54.

In addition, a helical groove 57 may be formed on the outer circumferential surface of the rotation shaft 50. At the lower end of the helical groove 57, an oil hole **57*a* that is in fluid communication with the cavity 53 is provided. The oil hole 57*a* is formed at a position where the oil hole 57*a* is not blocked by the oil raising member 100 disposed in the cavity 53. In other words, the position of the oil hole 57*a* may be determined according to the position of the top end of the oil raising member 100 provided in the cavity 53**.

Some of the oil raised by the oil raising member 100 is discharged to the outside of the rotation shaft 50 through the oil hole **57*a* and rises along the helical groove 57. The oil rising along the helical groove 57 lubricates between the inner surface of the through holes of the shaft supporter 22 and the rotation shaft 50 so that the rotation shaft 50 may rotate smoothly with respect to the shaft supporter 22. Further, the oil raised along the helical groove 57 is supplied to the bearing 24 provided between the disc part 52 and the top surface of the shaft supporter 22 to lubricate the bearing 24**.

In addition, a second oil passage 56 may be provided in the eccentric part 51. The second oil passage 56 is formed to be inclined with respect to the longitudinal direction of the eccentric part 51. One end of the second oil passage 56 is connected to the upper end of the helical groove 57. Therefore, some of the oil supplied to the bearing 24 along the helical groove 57 moves to the upper side of the eccentric part 51 along the second oil passage 56. At this time, since the second oil passage 56 is inclined, when the rotation shaft 50 rotates, the oil may be moved to the upper end of the eccentric part 51 by the centrifugal force. The oil moved to the upper end of the eccentric part 51 may be supplied to the connecting rod 35 coupled to the eccentric part 51.

The stationary shaft 60 is inserted into the cavity 53 of the rotation shaft 50 and the bottom end of the stationary shaft 60 is disposed to be immersed in the oil of the oil reservoir 12. A predetermined gap is provided between the stationary shaft 60 and the inner surface of the cavity 53 of the rotation shaft 50. Further, a helical blade 61 is formed on the outer circumferential surface of the stationary shaft 60. Therefore, a helical oil passage 63 is provided between the stationary shaft 60 and the inner surface of the cavity 53 of the rotation shaft 50.

In addition, as illustrated in FIGS. 1 and 2, the stationary shaft 60 is provided with a protruding portion 65 to which a fixing member 15 is coupled at the bottom end of the stationary shaft 60. The protruding portion 65 may be formed with a through hole 65*a* through which the fixing member 15 passes. Both ends of the fixing member 15 are fixed to the stator 41. Since the stator 41 is fixed to the frame 20 fixed to the airtight case 10, the stationary shaft 60 is also fixed to the frame 20. Therefore, when the rotation shaft 50 rotates with respect to the shaft supporter 22 fixed to the frame 20, the stationary shaft 60 maintains a stationary state.

In the embodiment as illustrated in FIG. 1, the stationary shaft 60 is fixed to the stator 41, but the stationary shaft 60 is not fixed to the stator 41 only. As another example, the stationary shaft 60 may be fixed directly to the frame 20 or the inner surface of the airtight case 10.

The oil raising member 100 is fixed to the cavity 53 of the rotation shaft 50 and is formed to surround the stationary shaft 60. The oil raising member 100 may be formed to have a length that surrounds the entire length of the stationary shaft 60. Therefore, the oil raising member 100 may be disposed in a state in which the lower end of the oil raising member 100 is immersed in the oil of the oil reservoir 12. Further, the lower end of the oil raising member 100 may be formed to be located at the same height as the bottom end of the rotation shaft 50 or to protrude downward from the bottom end of the rotation shaft 50.

The oil raising member 100 may increase the drag force of the oil moving along the helical oil passage 63 of the stationary shaft 60 so that the oil in the oil reservoir 12 of the airtight case 10 is effectively supplied to the upper portion of the rotation shaft 50. In other words, the oil raising member 100 is disposed in the inner surface of the cavity 53, rotates integrally with the rotation shaft 50, and moves relative to the stationary shaft 60, thereby raising the oil stored in the oil reservoir 12 of the lower portion of the airtight case 10.

The oil raising member 100 may be formed in various shapes as long as it can improve the drag force of the oil.

Hereinafter, various examples of the oil raising member 100 will be described in detail with reference to FIGS. 4A to 9.

Figure 4A:
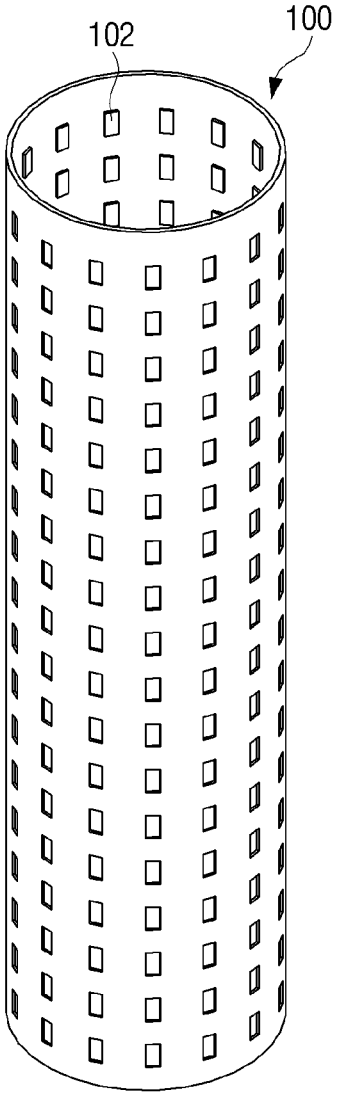
FIGS. 4A, 4B, and 4C are views illustrating a case where the oil raising member of the hermetic compressor of FIG. 1 includes a plurality of protrusions.

As an example, the oil raising member 100 of the hermetic compressor 1 may be formed to include a plurality of protrusions 102 protruding inward as illustrated in FIG. 4A.

FIG. 4A is a perspective view illustrating an oil raising member according to an embodiment of the present disclosure.

Referring to FIG. 4A, the oil raising member 100 is formed in a hollow cylindrical shape, and the plurality of protrusions 102 protrude inward from the inner surface of the oil raising member 100. In other words, the plurality of protrusions 102 are formed on the inner surface of the oil raising member 100 to face the stationary shaft 60. In this embodiment, each of the protrusions 102 is formed in a rectangular parallelepiped shape, but the shape of the protrusion 102 is not limited thereto. The plurality of protrusions 102 may be formed in various shapes as long as they can increase the drag force of the oil.

Each of the plurality of protrusions 102 may be formed in a rectangular parallelepiped shape the inside 104 (see FIG. 4C) of which is hollow. Alternatively, each of the plurality of protrusions 102 may be formed in a rectangular parallelepiped shape the inside of which is filled.

The oil raising member 100 as illustrated in FIG. 4A may be formed by molding the plurality of protrusions 102 on a circular pipe. Alternatively, the oil raising member 100 having the plurality of protrusions 102 may be formed by extrusion, injection, or the like using a mold.

When the oil raising member 100 is formed of a circular pipe, the oil raising member 100 may be fixed to the cavity 53 of the rotation shaft 50 by press fitting, screwing, gluing or the like. For example, the oil raising member 100 may be inserted into and fixed to the cavity 53 of the rotation shaft 50 with interference fit. Alternatively, a female screw (not illustrated) may be formed on a portion of the cavity 53 of the rotation shaft 50 and a male screw (not illustrated) may be formed on a portion of the outer circumferential surface of the oil raising member 100 so that the oil raising member 100 is fixed to the cavity 53 of the rotation shaft 50 by screwing. Alternatively, the oil raising member 100 may be fixed to the cavity 53 of the rotation shaft 50 by applying an adhesive to the outer circumferential surface of the oil raising member 100 and the inner surface of the cavity 53 of the rotation shaft 50.

As another embodiment, the oil raising member 100 may be formed using a thin flat plate, for example, a sheet.

Figure 4B:
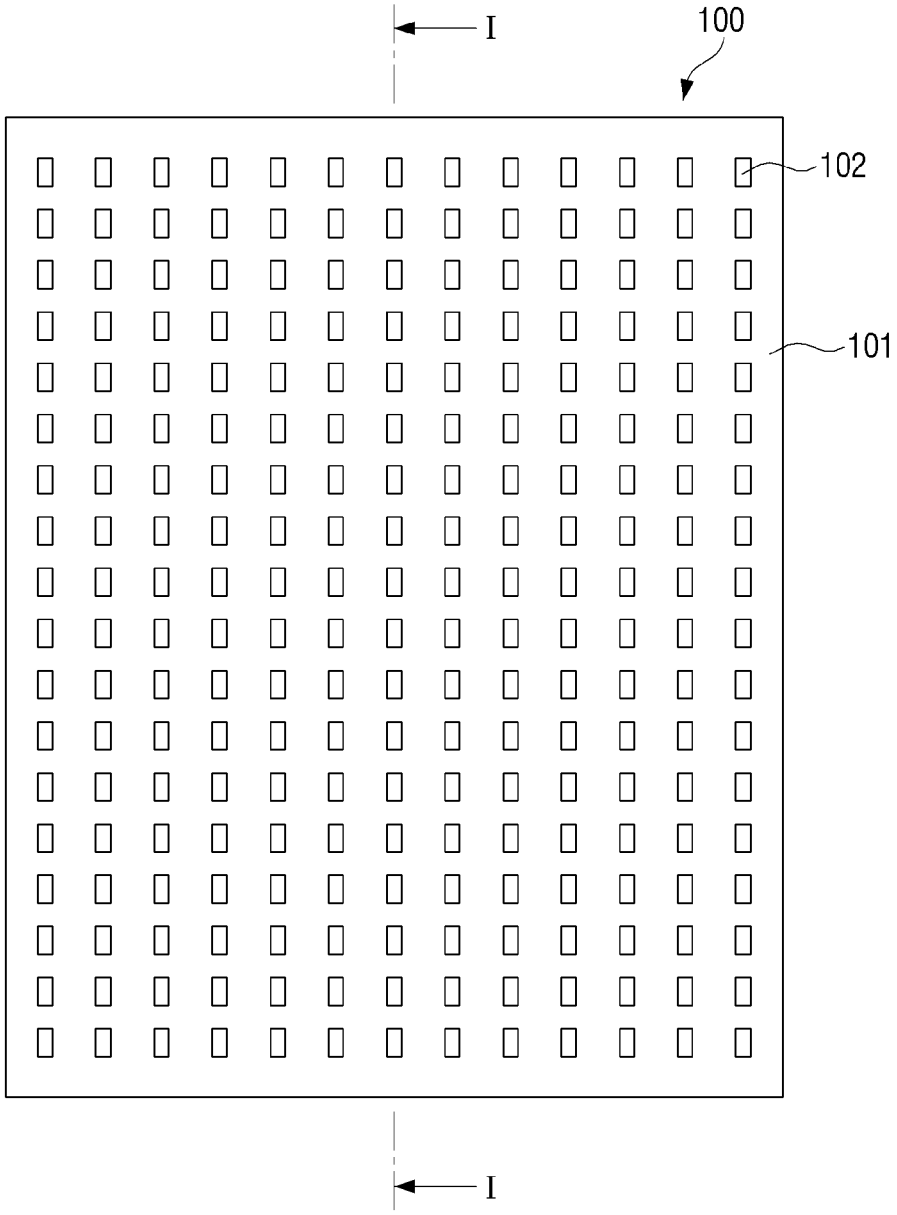
Figure 4C:
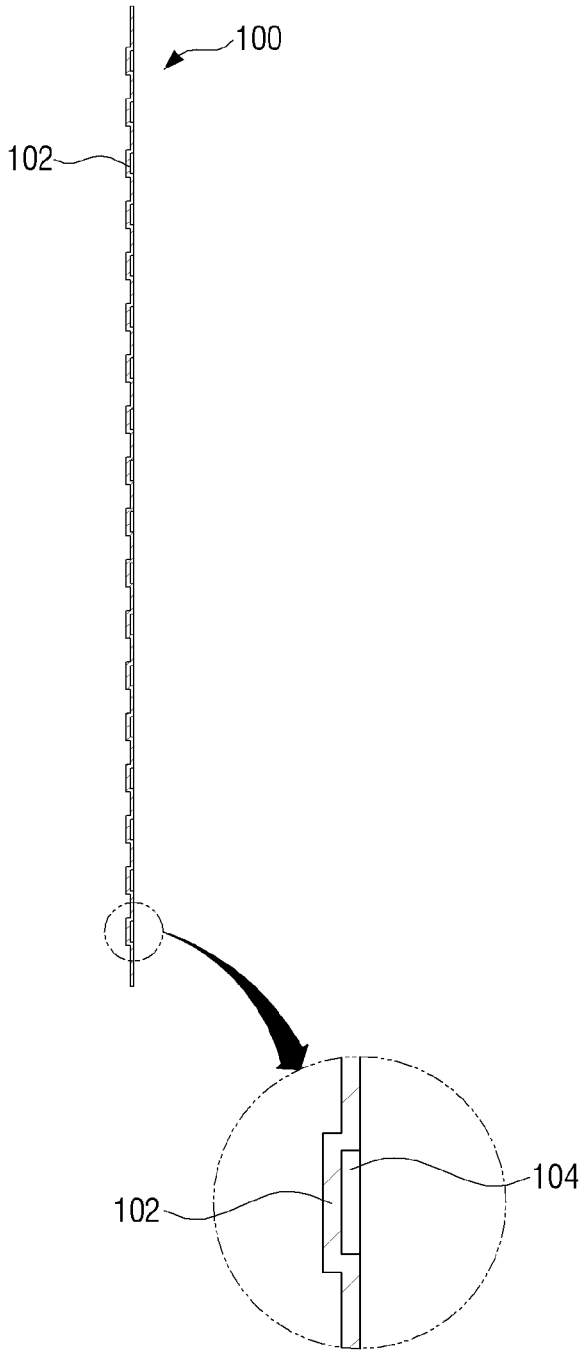

FIG. 4B is a plan view illustrating a sheet forming an oil raising member, and FIG. 4C is a longitudinal sectional view illustrating the oil raising member in FIG. 4B taken along a line I-I.

The oil raising member 100 may be formed by bending a flat sheet 101 having elasticity into a cylindrical shape. At this time, a plurality of protrusions 102 are formed on one surface of the sheet 101, and the sheet 101 is folded in such a manner that the plurality of protrusions 102 face the inside so that the oil raising member 100 having the cylindrical shape may be formed as illustrated in FIG. 4A. When the oil raising member 100 is formed by bending the sheet 101, the oil raising member 100 may be fixed to the cavity 53 of the rotation shaft 50 by the elastic force of the sheet 101.

The oil raising member 100 may be formed of a metal thin plate, a film material, a plastic such as a synthetic resin, or the like. When the oil raising member 100 is formed of a plastic having abrasion resistance and low friction characteristics, the wear of the stationary shaft 60 and the oil raising member 100 may be minimized so that the lifetime of the hermetic compressor 1 may be prolonged.

Further, when the oil raising member 100 is formed of the sheet 101, it is easy to form the plurality of protrusions or grooves on the thin plate by using a metal mold so that the productivity may be improved and the cost may be reduced compared with the case where the plurality of protrusions or grooves are directly formed on the inner surface of the cavity 53 of the rotation shaft 50.

As illustrated in FIG. 4A, in the case where the plurality of protrusions 102 are formed on the inner surface of the oil raising member 100, when the rotation shaft 50 rotates, the oil raising member 100 rotates integrally with the rotation shaft 50. Then, the drag force of raising the oil upward is increased by the plurality of protrusions 102 provided on the inner surface of the rotating oil raising member 100 so that the oil, which is raised along the helical oil passage 63 of the stationary shaft 60 by the adhesive force, may be more easily raised along the helical oil passage 63 of the stationary shaft 60. Therefore, even when the rotational speed of the rotation shaft 50 is extremely low as used for high efficiency in recent refrigerators, the oil stored in the lower portion of the airtight case 10 may be supplied to the upper portion by the rotation shaft 50.

The oil discharged to the upper side of the rotation shaft 50 is supplied between the cylinder 31 and the piston 33 of the compression mechanism 30 and the bearing 24 supporting the rotation shaft 50. The oil that has lubricated and cooled the compression mechanism 30 and the bearing 24 is again collected in the oil reservoir 12 of the airtight case 10.

In FIGS. 4A to 4C, the plurality of protrusions 102 of the oil raising member 100 have the rectangular parallelepiped shapes. However, the shape of the plurality of protrusions 102 of the oil raising member 100 is not limited thereto.

Figure 5A:
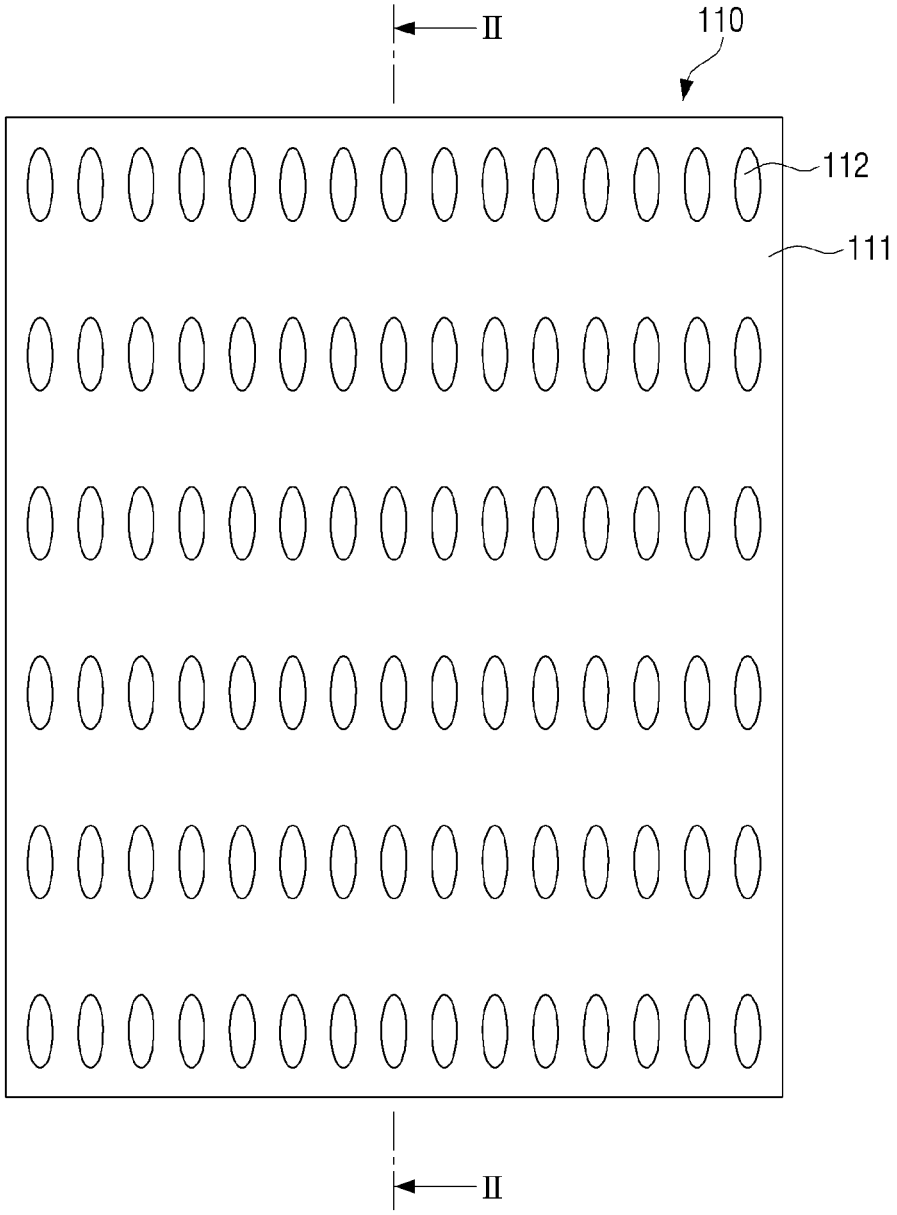
FIGS. 5A, 5B, and 5C are views illustrating a case where the oil raising member of the hermetic compressor of FIG. 1 includes a plurality of embossings.
Figure 5B:
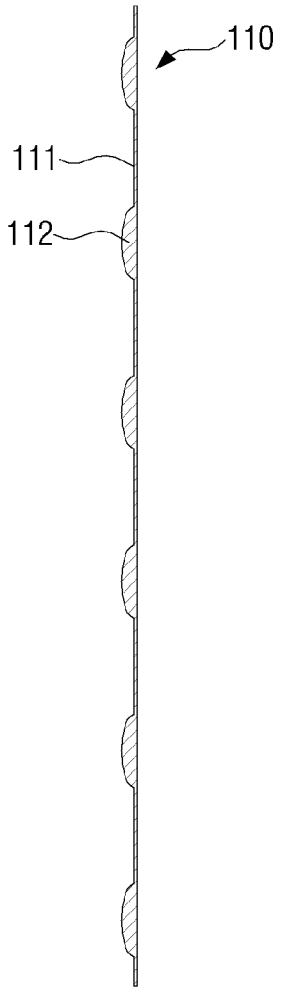
Figure 5C:
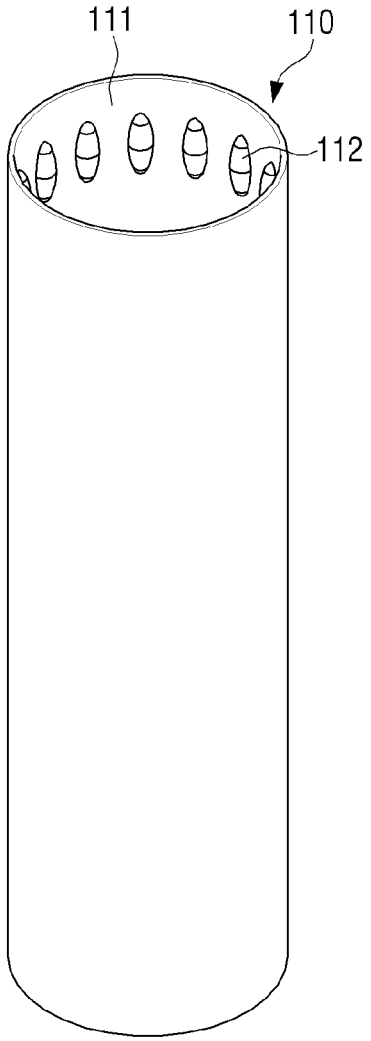

FIGS. 5A, 5B, and 5C are views illustrating a case where a plurality of protrusions of the oil raising member of the hermetic compressor of FIG. 1 are formed by the embossing process.

FIG. 5A is a plan view illustrating a sheet formed by the embossing process, and FIG. 5B is a longitudinal sectional view illustrating the sheet in FIG. 5A taken along a line II-II.

As illustrated in FIGS. 5A and 5B, a plurality of embossings 112 may be formed on one surface of a sheet 111 through the embossing process. The plurality of embossings 112 are formed in protrusions whose cross-sections are substantially elliptical. At this time, the embossings 112 of FIG. 5B, that is, the protrusions are formed in a shape the inside of which is filled unlike the protrusions 102 of FIG. 4B.

When the sheet 111 having the plurality of embossings 112 of FIG. 5A formed by the embossing process is bent into a cylindrical shape such that the plurality of embossings 112 are directed inward, the oil raising member 110 having the cylindrical shape is formed as illustrated in FIG. 5C. When this oil raising member 110 is inserted into the cavity 53 of the rotation shaft 50, the oil raising member 110 is fixed to the cavity 53 of the rotation shaft 50 by the elastic force of the sheet 111.

In the above description, the cross-section of each of the plurality of protrusions 102 and plurality of embossings 112 is a rectangle or an ellipse. However, the cross-section of each of the plurality of protrusions 102 and plurality of embossings 112 is not limited thereto. For example, although not illustrated, the cross-section of each of the plurality of protrusions 102 and plurality of embossings 112 may be formed in any one of a polygonal shape, a circular shape, and a semicircular shape other than a rectangular shape.

Figure 6A:
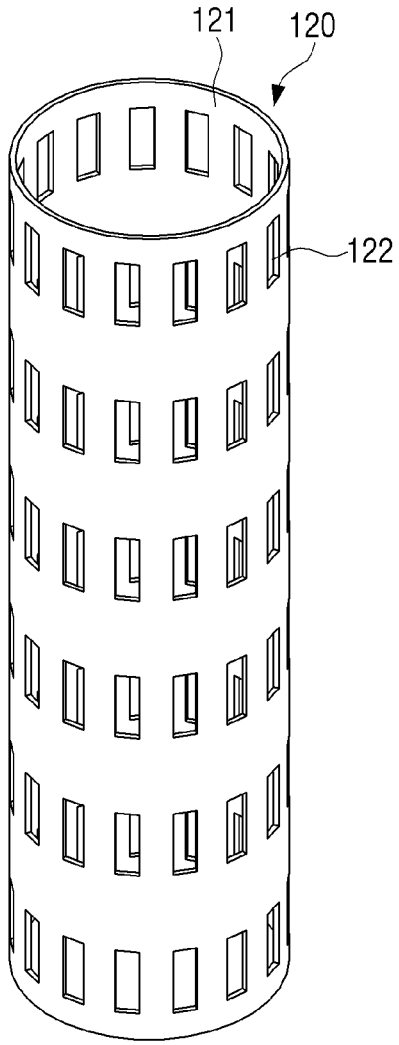
FIGS. 6A, 6B, and 6C are views illustrating a case where the oil raising member of the hermetic compressor of FIG. 1 includes a plurality of holes.

FIG. 6A is a perspective view illustrating an oil raising member according to another embodiment of the present disclosure.

Referring to FIG. 6A, an oil raising member 120 is formed in a hollow cylindrical shape, and a plurality of holes are formed in the outer circumferential surface of the oil raising member 120. The plurality of holes 122 are formed as through holes passing through the outer circumferential surface of the oil raising member 120. In the present embodiment, each of the plurality of holes 122 is formed in a rectangular parallelepiped shape, but the shape of each of the plurality of holes 122 is not limited thereto. The plurality of holes 122 may be formed in various shapes as long as they can increase the drag force of the oil. For example, the plurality of holes 122 may be formed in a polygonal shape other than a rectangular shape, a circular shape, a semicircular shape, an elliptical shape, or the like.

In FIG. 6A, each of the plurality of holes 122 is formed to penetrate the outer circumferential surface of the oil raising member 120. However, although not illustrated, each of the plurality of holes 122 may be formed not to penetrate the outer circumferential surface of the oil raising member 120. In other words, the plurality of holes 122 may be formed in concave grooves on the outer circumferential surface of the oil raising member 120.

The oil raising member 120 as illustrated in FIG. 6A may be formed by machining the plurality of holes 122 in a circular pipe. Alternatively, a cylindrical oil raising member 120 having the plurality of holes 122 may be formed by extrusion, injection, or the like using a mold.

When the oil raising member 120 is formed of a circular pipe, the oil raising member 120 may be fixed into the cavity 53 of the rotation shaft 50 by press fitting, screwing, gluing or the like as described above.

As another embodiment, the oil raising member 120 may be formed using a thin plate for example, a sheet 121.

Figure 6B:
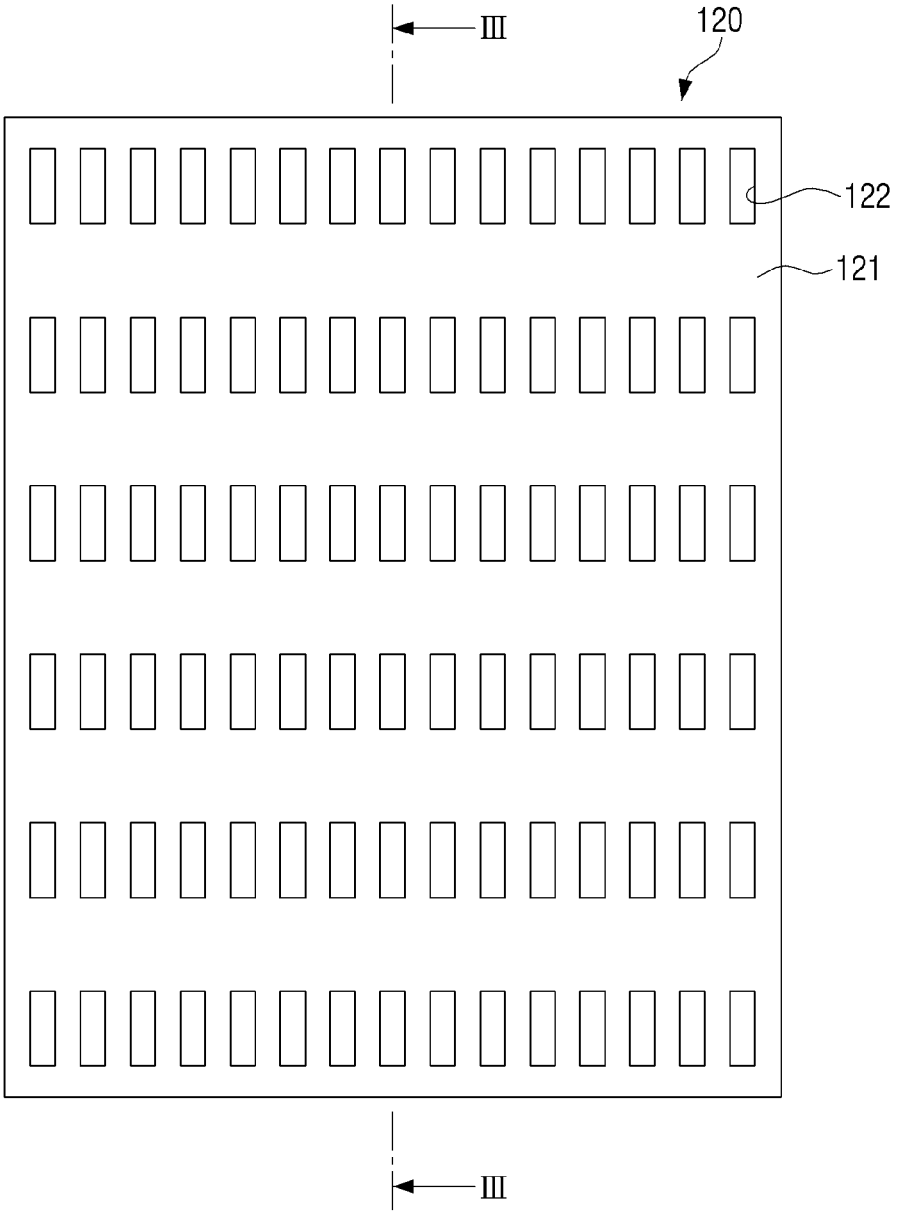
Figure 6C:
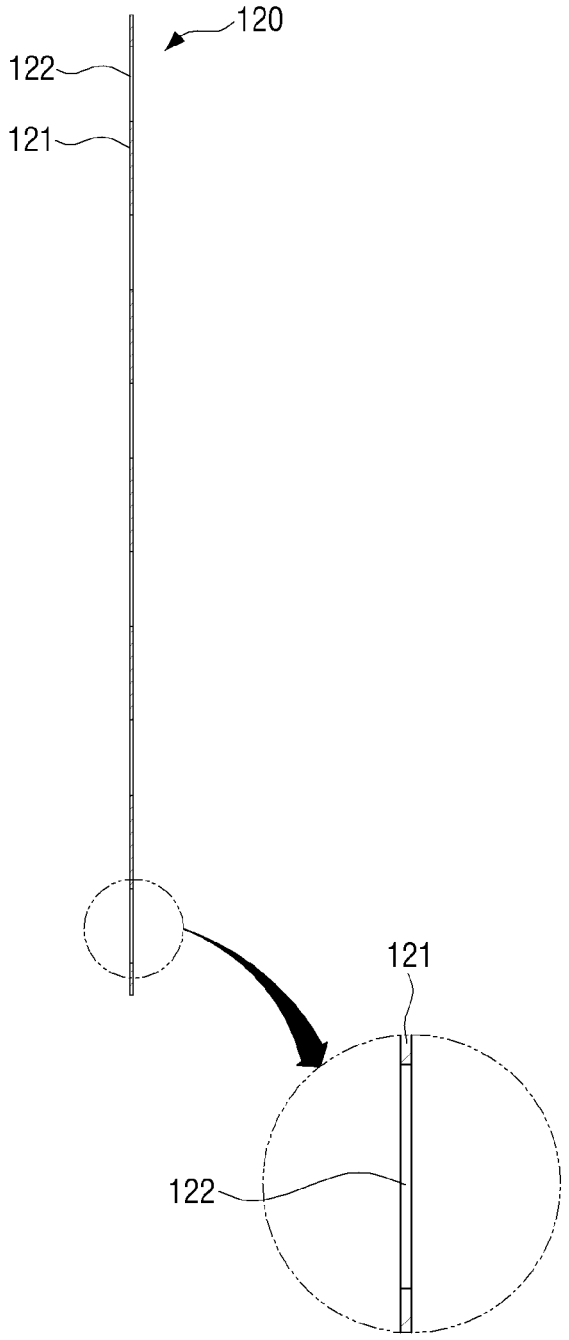

FIG. 6B is a plan view illustrating a sheet forming an oil raising member, and FIG. 6C is a longitudinal sectional view illustrating the oil raising member in FIG. 6B taken along a line III-III.

The oil raising member 120 may be formed by bending a flat sheet 121 having elasticity into a cylindrical shape. At this time, a plurality of grooves or through holes 122 are formed in the sheet 121, and the sheet 121 is bent in such a manner that the plurality of grooves face the inside so that the oil raising member 120 having the cylindrical shape may be formed as illustrated in FIG. 6A. When the oil raising member 120 is formed by bending the sheet 121, the oil raising member 120 may be fixed to the cavity 53 of the rotation shaft 50 by the elastic force of the sheet 121.

As another example, in order to improve the drag force of the oil, the surface roughness of one surface of the oil raising member may be increased without forming the plurality of protrusions 102, the plurality of through holes 122, and the plurality of grooves as described above.

Figure 7:
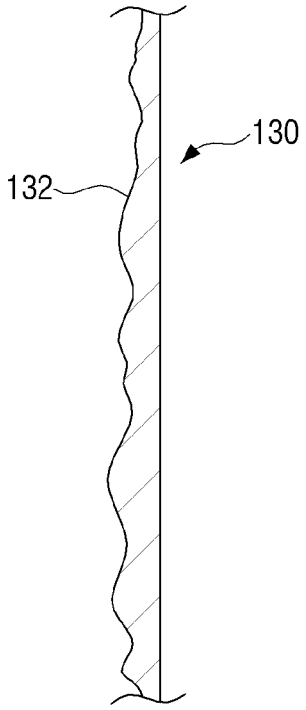
FIG. 7 is an enlarged sectional view illustrating the surface roughness of an inner surface of the oil raising member of the hermetic compressor of FIG. 1.

For example, the surface roughness of the surface 132 of the oil raising member 130 facing the stationary shaft 60 may be made large enough to improve the drag force of the oil as illustrated in FIG. 7. Here, FIG. 7 is an enlarged sectional view illustrating the surface roughness of the inner surface of the oil raising member 130 of the hermetic compressor of FIG. 1.

Figure 8A:
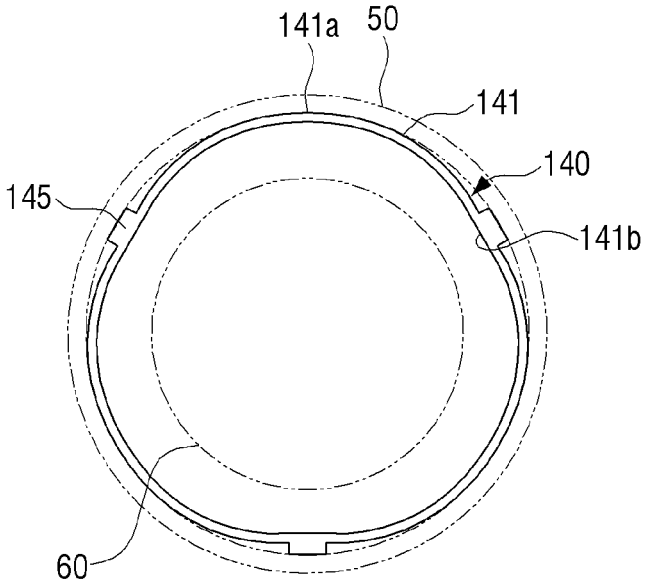
FIGS. 8A, 8B, and 8C are views illustrating a case where the oil raising member of the hermetic compressor of FIG. 1 includes a plurality of extending projections.

FIG. 8A is a cross-sectional view illustrating an oil raising member according to another embodiment of the present disclosure.

Referring to FIG. 8A, the transverse cross-section of the oil raising member 140 inserted in the cavity 53 of the rotation shaft 50 is formed in a lobe shape. Here, as illustrated in FIG. 8A, the lobe shape refers to a case in which the circumferential surface 141 forming the oil raising member 140 includes at least two convex portions 141*a* and at least two concave portions 141*b* formed alternately. In the case of FIG. 8A, the circumferential surface 141 of the oil raising member 140 is formed to have three convex portions 141*a* and three concave portions 141*b* arranged in parallel in the longitudinal direction.

Figure 8B:
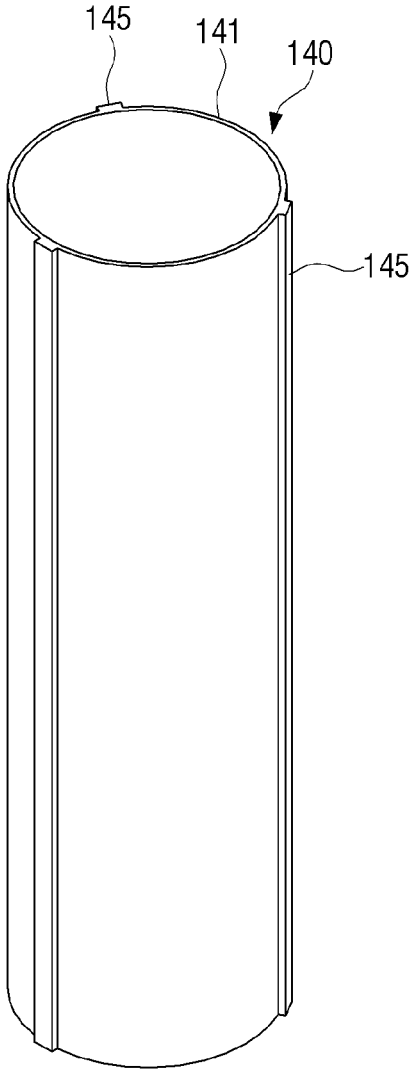

FIG. 8B is a perspective view illustrating the oil raising member 140 not inserted into the cavity 53 of the rotation shaft 50.

The oil raising member 140 is formed in a hollow circular pipe having elasticity. On the outer surface of the circumferential surface 141 of the oil raising member 140, that is, the surface facing the cavity 53 of the rotation shaft 50, three extending protrusions 145 having a length corresponding to the length of the oil raising member 140 in the longitudinal direction of the oil raising member 140 are provided at predetermined intervals in the circumferential direction. The oil raising member 140 may be formed to have a circular cross-section before being inserted into the cavity 53 of the rotation shaft 50.

Therefore, when the oil raising member 140 of FIG. 8B is inserted into the cavity 53 of the rotation shaft 50, the oil raising member 140 is deformed by the plurality of the extending protrusions 145 so that the oil raising member 140 is fixed to the cavity 53 of the rotation shaft 50 in a lobe shape as illustrated in FIG. 8A. At this time, the portions of the circumferential surface 141 of the oil raising member 140 on which the three extending protrusions 145 are formed become the three concave portions 141*b* that are not in contact with the inner surface of the cavity 53 of the rotation shaft 50, and the middle portions between the two adjacent extending protrusions 145 become the three convex portions 141*a* that are in contact with the inner surface of the cavity 53 of the rotation shaft 50.

In FIGS. 8A and 8B, three extending protrusions 145 are formed on the circumferential surface 141 of the oil raising member 140. However, the number of the extending protrusions 145 is not limited thereto. The number of the extending protrusions 145 of the oil raising member 140 may be two or four or more.

As described above, when the oil raising member 140 is inserted into the cavity 53 of the rotation shaft 50 so that the cross-section of the oil raising member 140 is a lobe shape, as illustrated in FIG. 8A, the volume of the space between the stationary shaft 60 and the inner surface of the oil raising member 140 changes in the circumferential direction of the oil raising member 140 so that the drag force for raising the oil may be improved when the rotation shaft 50 rotates.

The oil raising member 140 as illustrated in FIG. 8B has a plurality of extending protrusions 145 formed on the outer circumferential surface of the circular pipe in the longitudinal direction. However, in another embodiment, the oil raising member 140 may be formed using a thin flat plate, for example, a sheet.

Figure 8C:
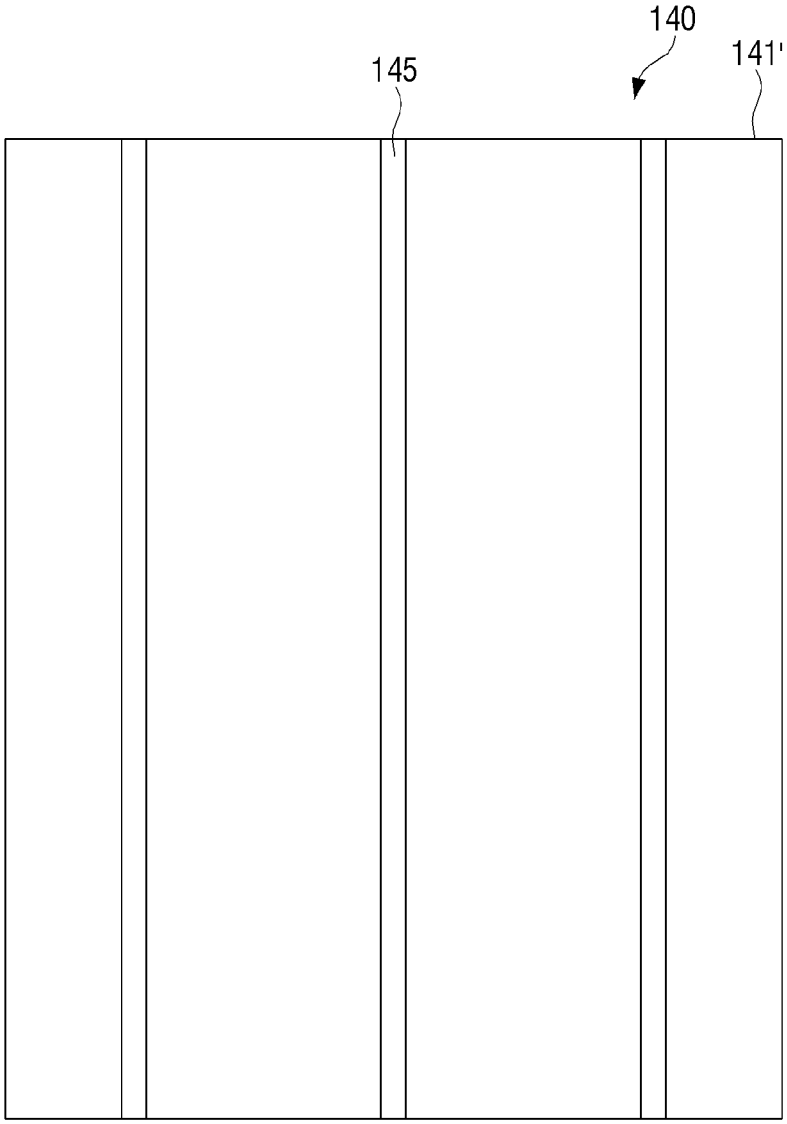

FIG. 8C is a plan view illustrating a sheet forming the oil raising member.

The oil raising member 140 may be formed by bending a flat sheet 141' having elasticity in a cylindrical shape. At this time, when the plurality of extending protrusions 145 are formed on the sheet 141' in the longitudinal direction, and the sheet 141' is bent in such a manner that the plurality of extending protrusions 145 are directed to outward so that the oil raising member 140 having the cylindrical shape may be formed as illustrated in FIG. 8B. When the oil raising member 140 is formed by bending the sheet 141', the oil raising member 140 may be fixed to the cavity 53 of the rotation shaft 50 by the elastic force of the sheet 141'.

Figure 9A:
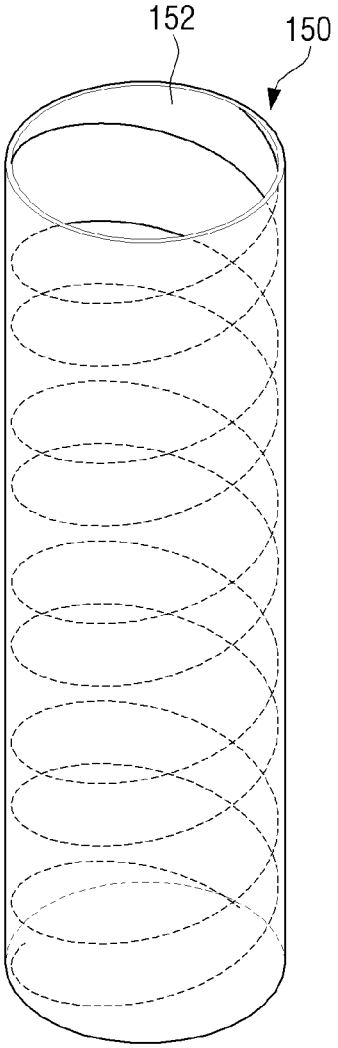
FIGS. 9A, 9B, and 9C are views illustrating a case where the oil raising member of the hermetic compressor of FIG. 1 includes a helical groove.

FIG. 9A is a perspective view illustrating an oil raising member according to another embodiment of the present disclosure.

Referring to FIG. 9A, an oil raising member 150 is formed in a hollow cylindrical shape, and a helical groove 152 is formed on the inner circumferential surface of the oil raising member 150. The helical groove 152 is formed on the entire inner circumferential surface of the oil raising member 150. In the present embodiment, the helical groove 152 is formed on the inner surface of the oil raising member 150. However, a helical protrusion may be formed on the inner surface of the oil raising member 150. The helical groove 152 or the helical protrusion may be formed in various shapes as long as it can increase the drag force of the oil. For example, the helical groove 152 may be formed in a double helix.

The oil raising member 150 as illustrated in FIG. 9A may be formed by machining the helical groove 152 on the inner surface of the circular pipe. Alternatively, the cylindrical oil raising member 150 having the helical groove 152 may be formed by extrusion, injection, or the like using a mold.

When the oil raising member 150 is formed of a circular pipe, the oil raising member 150 may be fixed into the cavity 53 of the rotation shaft 50 by press fitting, screwing, gluing or the like as described above.

As another embodiment, the oil raising member 150 may be formed using a thin flat plate for example, a sheet.

Figure 9B:
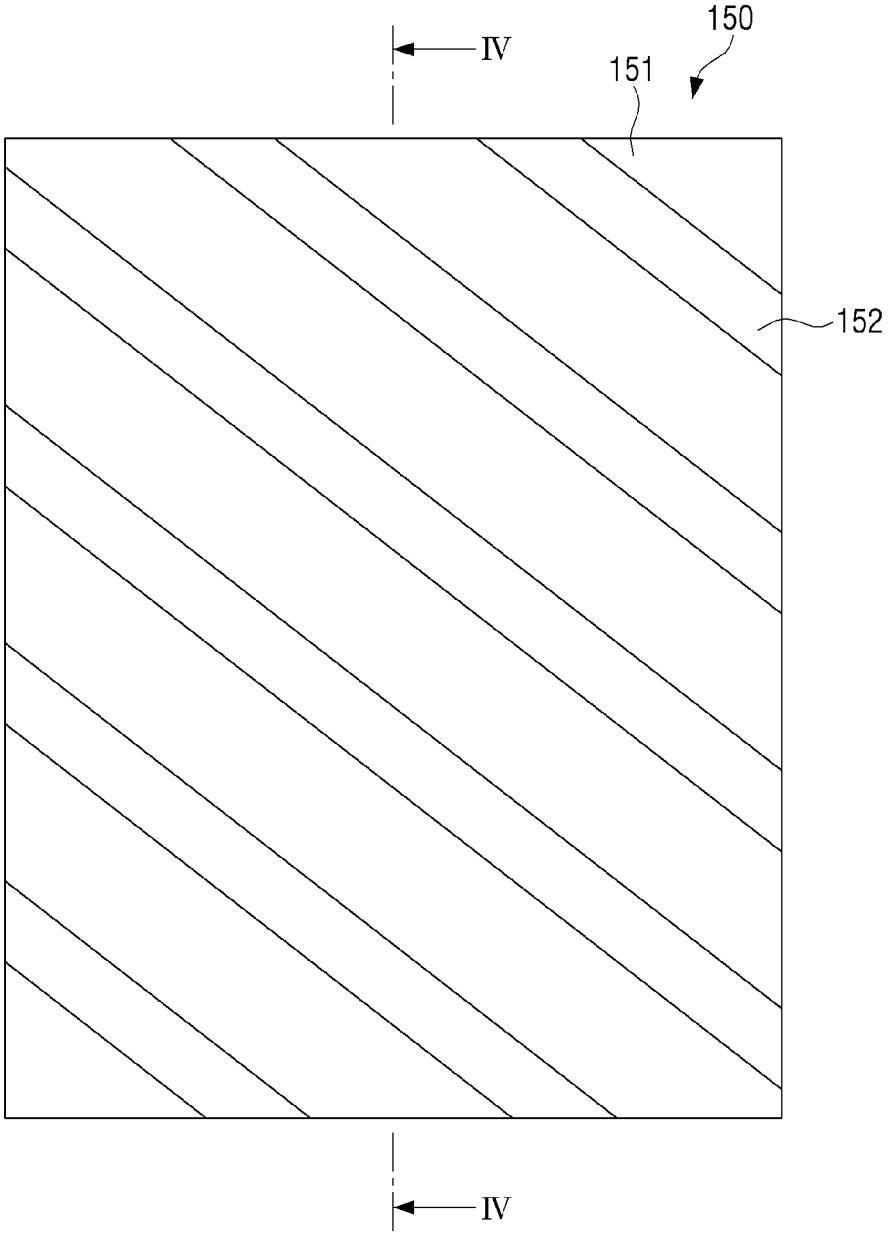
Figure 9C:
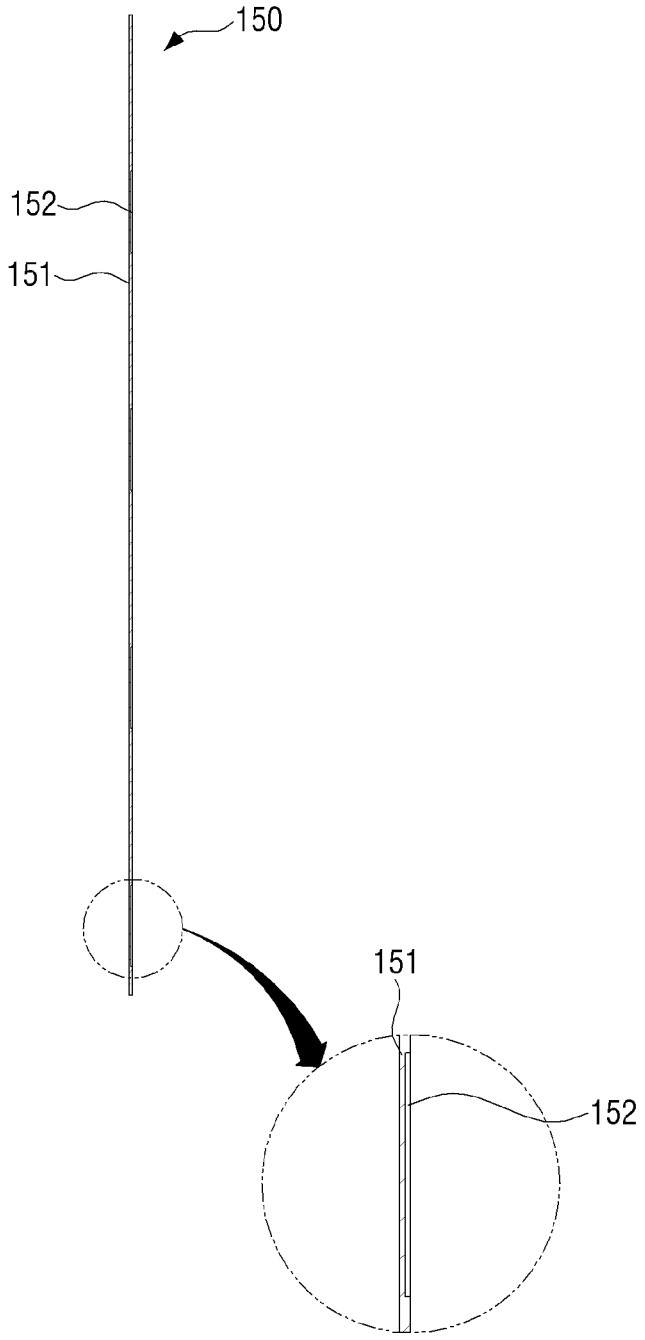

FIG. 9B is a plan view illustrating a sheet forming an oil raising member, and FIG. 9C is a longitudinal sectional view illustrating the oil raising member in FIG. 9B taken along a line IV-IV.

The oil raising member 150 may be formed by bending a flat sheet 151 having elasticity into a cylindrical shape. At this time, a plurality of helical grooves 152 are formed on one surface of the sheet 151 so that a helical groove 152 is formed on the sheet 151 when the sheet 151 is rolled. The sheet 151 is rolled in such a manner that the plurality of helical grooves 152 face the inside so that the oil raising member 150 having the cylindrical shape may be formed as illustrated in FIG. 9A. When the oil raising member 150 is formed by bending the sheet 151, the oil raising member 150 may be fixed to the cavity 53 of the rotation shaft 50 by the elastic force of the sheet 151.

In the above-described embodiments, the helical groove 152 is provided on the outer circumferential surface of the stationary shaft 60, and the plurality of protrusions 102 and plurality of holes 122, the plurality of holes 122, the large surface roughness, or the helical groove 152 are formed on the inner surface of the oil raising member 100, 110, 120, 130, and 150 facing the stationary shaft 60.

When the oil raising member 100, 110, 120, 130, and 150 having the plurality of protrusions 102 and plurality of holes 122, the plurality of holes 122, the large surface roughness, or the helical groove 152 is provided in the cavity 53 of the rotation shaft 50 as described above, the drag force for raising the oil is increased so that the oil may be supplied at a rotational speed much lower than that of the conventional hermetic compressor in which the oil is supplied by the rotation shaft having the cavity with the smooth inner surface.

As another example, when the helical groove 152 or the helical protrusion is formed on the inner surface of the oil raising member 150, the helical groove or the helical protrusion may not be formed on the outer circumferential surface of the stationary shaft 60. A case in which a helical groove or a helical protrusion is not formed on the outer circumferential surface of the stationary shaft 60' is illustrated in FIG. 10.

Figure 10:
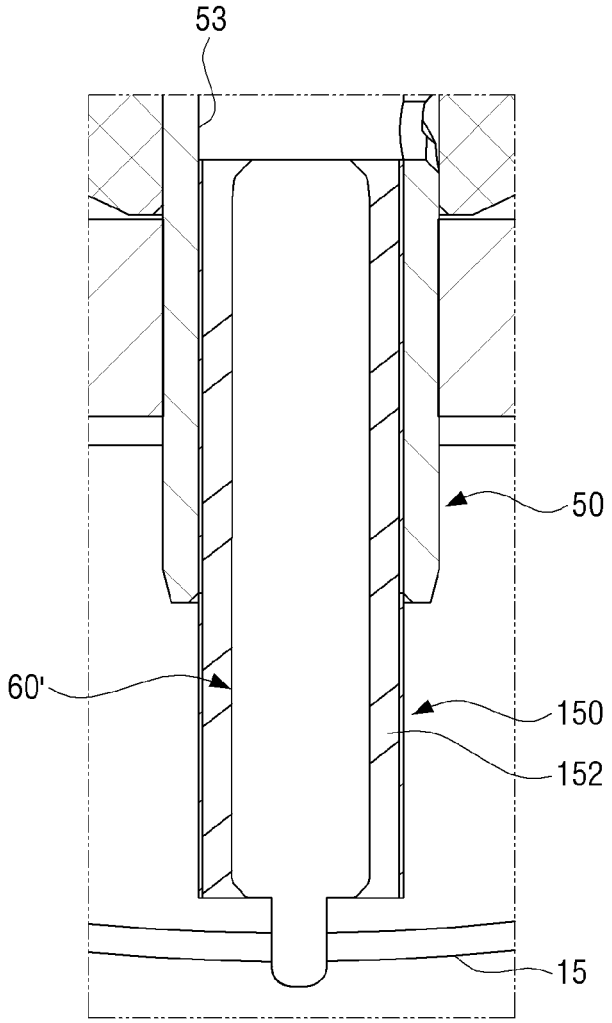
FIG. 10 is a partial longitudinal sectional view illustrating a rotation shaft and a stationary shaft to which the oil raising member of FIG. 9A is coupled.

FIG. 10 is a partial longitudinal sectional view illustrating a stationary shaft and a rotation shaft to which the oil raising member of FIG. 9A is coupled.

Referring to FIG. 10, the outer circumferential surface of the stationary shaft 60' fixed to the inside of the airtight case 10 has a smooth surface on which no helical grooves or helical protrusions are formed. In other words, the stationary shaft 60' is formed in a cylindrical shape having a smooth surface. At this time, since the helical groove 152 is formed on the inner surface of the oil raising member 150 facing the outer circumferential surface of the stationary shaft 60', when the rotation shaft 50 rotates, the oil in the oil reservoir 12 of the airtight case 10 may be supplied to the upper side of the rotation shaft 50 by the helical groove 152 of the oil raising member 150.

As another example, a plurality of protrusions may be formed on the outer circumferential surface of the stationary shaft in order to increase the drag force of the oil by the oil raising member.

Figure 11:
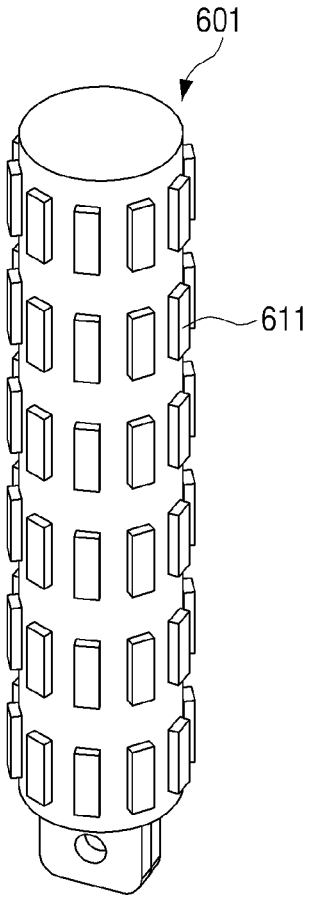
FIG. 11 is a perspective view illustrating a stationary shaft on which a plurality of protrusions are formed.

FIG. 11 is a perspective view illustrating a stationary shaft on which a plurality of protrusions are formed.

A plurality of protrusions 611 may be formed at regular intervals on the outer circumferential surface of a cylindrical stationary shaft 601. The plurality of protrusions 611 are formed in such a manner that when the stationary shaft 601 is inserted into the oil raising member 150 having the helical groove 152, the plurality of protrusions 611 are not in contact with the inner surface of the oil raising member 150.

The stationary shaft 601 having the plurality of protrusions 611 as illustrated in FIG. 11 may be inserted into the inside of the oil raising member 150 provided in the cavity 53 of the rotation shaft 50 instead of the stationary shaft 60' of FIG. 10. When the plurality of protrusions 611 formed on the outer circumferential surface of the stationary shaft 601, the drag force for moving the oil upward is increased as compared with the stationary shaft 60' having a smooth outer circumferential surface as illustrated in FIG. 10, so that the oil may be supplied to the upper side of the rotation shaft 50 even at a lower rotational speed.

Figure 12:
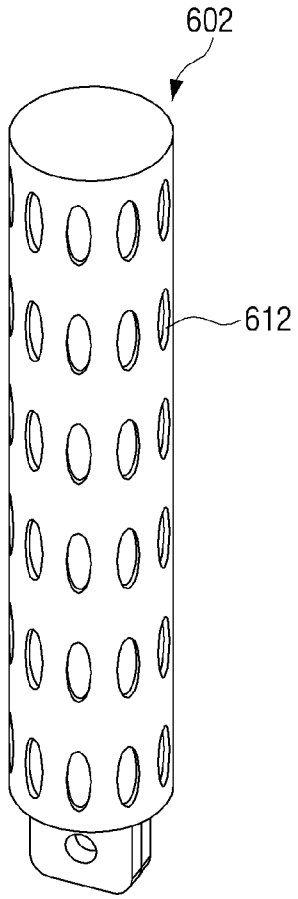
FIG. 12 is a perspective view illustrating a stationary shaft on which a plurality of grooves are formed.

FIG. 12 is a perspective view illustrating a stationary shaft on which a plurality of grooves are formed.

A plurality of grooves 612 may be formed to have predetermined depths at regular intervals on an outer circumferential surface of a cylindrical stationary shaft 602.

The stationary shaft 602 having the plurality of grooves 612 as illustrated in FIG. 12 may be inserted into the inside of the oil raising member 150 having the helical groove 152 provided in the cavity 53 of the rotation shaft 50 instead of the stationary shaft 60' of FIG. 10. When the plurality of grooves 612 are formed on the outer circumferential surface of the stationary shaft 602, the drag force for moving the oil upward is increased as compared with the stationary shaft 60' having a smooth outer circumferential surface as illustrated in FIG. 10, so that the oil may be supplied to the upper side of the rotation shaft 50 even at a lower rotational speed.

In the above description, the plurality of grooves 612 or the plurality of protrusions 611 are formed on the outer circumferential surface of the cylindrical stationary shaft 601 and 602. However, the drag force for raising the oil along the helical groove 152 of the oil raising member 150 may be increased by increasing the surface roughness of the outer circumferential surface of the stationary shaft 60'.

As another example, a stationary shaft 603 may be formed to have a cross-section of a lobe shape. In other words, the stationary shaft 603 may be formed in a columnar shape having a lobe-shaped cross-section. Then, the outer circumferential surface of the stationary shaft 603 has at least two convex portions 613 and at least two concave portions 614 arranged in parallel in the longitudinal direction.

Figure 13:
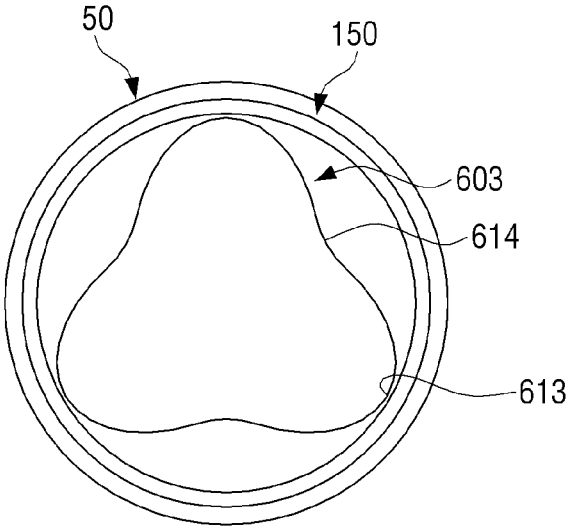
FIG. 13 is a cross-sectional view illustrating an oil raising member of a rotation shaft into which a stationary shaft having a lobe-shaped cross-section is inserted.

FIG. 13 is a cross-sectional view illustrating an oil raising member of a rotation shaft into which a stationary shaft having a lobe-shaped cross-section is inserted.

Referring to FIG. 13, the stationary shaft 603 having the lobe-shaped cross-section has three convex portions 613 and three concave portions 614 arranged in parallel in the longitudinal direction. As described above, when the stationary shaft 603 having the lobe-shaped cross-section is inserted into the oil raising member 150 having the helical groove 152 provided in the cavity 53 of the rotation shaft 50, the volume of the space between the stationary shaft 603 and the inner surface of the oil raising member 150 changes in the circumferential direction of the oil raising member 150 so that the drag force for raising the oil is improved when the rotation shaft 50 rotates.

In the above description, the reciprocating compressor is used as an example of the hermetic compressor 1 according to an embodiment of the present disclosure. However, the present disclosure may be applied to a scroll compressor.

Figure 14:
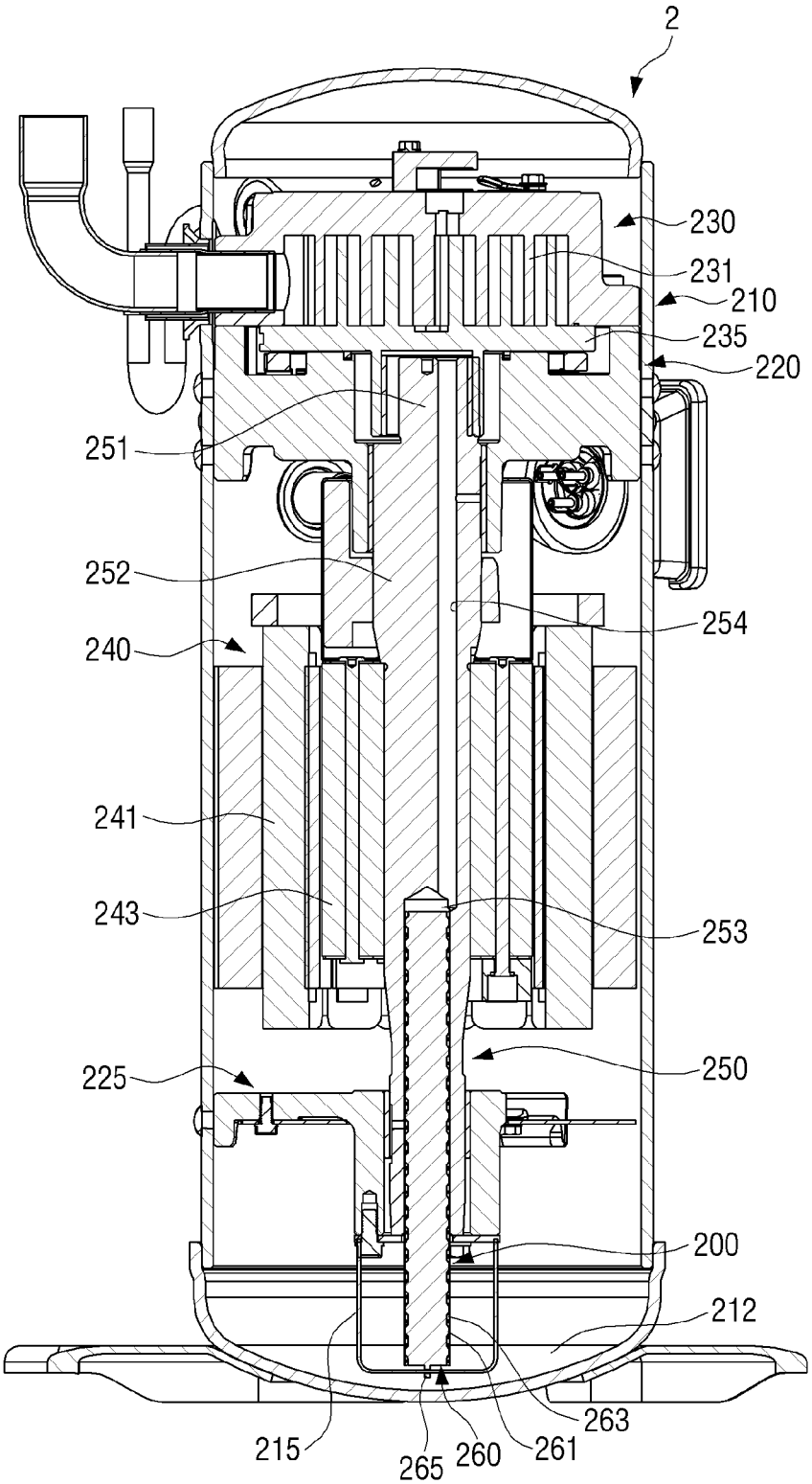
FIG. 14 is a longitudinal sectional view illustrating a scroll compressor which is an example of a hermetic compressor according to an embodiment of the present disclosure.

FIG. 14 is a longitudinal sectional view illustrating a scroll compressor which is an example of a hermetic compressor according to an embodiment of the present disclosure.

Referring to FIG. 14, a scroll compressor 2 according to an embodiment of the present disclosure may include an airtight case 210, a main frame 220, a sub frame 225, a compression mechanism 230, a motor mechanism 240, a rotation shaft 250, a stationary shaft 260, and an oil raising member 200.

The airtight case 210 is a cylindrical airtight container. The compression mechanism 230, the main frame 220, the sub frame 225, the motor mechanism 240, and the rotation shaft 250 are accommodated in the inner space of the airtight case 210. The main frame 220 and the sub frame 225 are fixed to the inside of the airtight case 210 at a predetermined interval in the vertical direction. The motor mechanism 240 is rotatably disposed between the main frame 220 and the sub frame 225.

The compression mechanism 230 is provided on the upper side of the main frame 220 and an oil reservoir 212 in which lubricant oil is stored is provided below the sub frame 225.

The compression mechanism 230 may include a fixed scroll 231 and an orbiting scroll 235. The fixed scroll 231 is provided on the upper side of the main frame 220 and the orbiting scroll 235 is accommodated in the space formed by the fixed scroll 231 and the main frame 220. The orbiting scroll 235 meshes with the fixed scroll 231 and is disposed between the fixed scroll 231 and the main frame 220 to rotate with respect to the fixed scroll 231.

A plurality of compression pockets formed between the fixed scroll 231 and the orbiting scroll 235 constitute compression chambers for compressing the refrigerant.

The motor mechanism 240 includes a stator 241 and a rotor 243. The stator 241 is fixed to the inner surface of the airtight case 210. The rotor 243 is rotatably inserted into the stator 241. Further, the rotation shaft 250 is inserted into the rotor 243 to penetrate therethrough.

The rotation shaft 250 includes a shaft part 252 formed to have a predetermined length and an eccentric part 251 extending from one end of the shaft part 252. The shaft part 252 of the rotation shaft 250 is press-fitted into the rotor 243 of the motor mechanism 240, and the one end portion of the shaft part 252 is supported by a bearing provided in the main frame 220. The eccentric part 251 of the rotation shaft 250 is coupled to the orbiting scroll 235.

The lower portion of the shaft part 252 is rotatably supported by a bearing provided in the sub frame 225.

A cavity 253 is provided at the bottom end of the shaft part 252 of the rotation shaft 250. The cavity 253 is in fluid communication with an oil passage 254 formed to pass through the shaft part 252 and the eccentric part 251.

The cavity 253 provided at the lower portion of the rotation shaft 250 is formed to raise the oil stored in the oil reservoir 212 of the airtight case 210. The cavity 253 is formed to have a circular cross-section and to have a predetermined depth from the bottom end of the rotation shaft 250. The depth or length of the cavity 253 may be variously determined in the same manner as the cavity 53 of the rotation shaft 50 of the above-described embodiment.

The oil supplied through the cavity 253 is discharged through the oil passage 254 to the upper side of the rotation shaft 250, that is, the fixed scroll 231 and the orbiting scroll 235.

The stationary shaft 260 is inserted into the cavity 253 of the rotation shaft 250, and the lower end of the stationary shaft 260 is disposed to be immersed in the oil of the oil reservoir 212. A predetermined gap is provided between the stationary shaft 260 and the inner surface of the cavity 253 of the rotation shaft 250. Further, a helical blade 261 may be formed on the outer circumferential surface of the stationary shaft 260. Therefore, a helical oil passage 263, that is, a helical groove may be provided between the stationary shaft 260 and the inner surface of the cavity 253 of the rotation shaft 250.

In addition, as illustrated in FIG. 14, the lower end of the stationary shaft 260 is provided with a protrusion 265 to which a fixing member 215 is coupled. The protrusion 265 may be formed with a through hole through which the fixing member 215 passes. Both ends of the fixing member 215 are fixed to the sub frame 225. Since the sub frame 225 is fixed to the airtight case 210, the stationary shaft 260 is also fixed to the airtight case 210. Therefore, when the rotation shaft 250 rotates with respect to the main frame 220 and the sub frame 225 fixed to the airtight case 210, the stationary shaft 260 is maintained at a stationary state.

The oil raising member 200 is fixed to the cavity 253 of the rotation shaft 250 and is formed to surround the stationary shaft 260. The oil raising member 200 increases the drag force of the oil moving along the helical oil passage 63 of the stationary shaft 260 so that the oil in the oil reservoir 12 of the airtight case 210 may be efficiently supplied to the compression mechanism 230 through the upper end of the rotation shaft 250. In other words, the oil raising member 200 is disposed on the inner surface of the cavity 253 and rotates integrally with the rotation shaft 250. The oil raising member 200 moves relative to the stationary shaft 260 to raise the oil stored in the oil reservoir 212 in the lower portion of the airtight case 210.

The oil raising member 200 may be formed to be the same as or similar to the oil raising members 100, 110, 120, 130, 140, and 150 of the hermetic compressor 1 according to the above-described embodiments, and thus a detailed description thereof is omitted.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

Although the present disclosure has been described with various embodiments, various changes and modifications may be suggested to one skilled in the art. It is intended that the present disclosure encompass such changes and modifications as fall within the scope of the appended claims.

What is claimed is:

1. A hermetic compressor comprising:

an airtight case including a lower portion configured to store oil;

a frame disposed in the airtight case;

a compression mechanism disposed in the frame and configured to compress a refrigerant;

a motor mechanism including a stator fixed to the frame and a rotor configured to rotate inside the stator;

a rotation shaft coupled to the rotor and including a cavity at a lower portion of the rotation shaft, wherein the rotation shaft is configured to rotate together with the rotor and operate the compression mechanism;

a stationary shaft inserted into the cavity of the rotation shaft, fixed to the airtight case, and including a helical groove formed on an outer circumferential surface of the stationary shaft; and an oil raising cylinder fixed to the cavity of the rotation shaft and configured to surround the stationary shaft, wherein the oil raising cylinder is configured to rotate integrally with the rotation shaft, move relative to the stationary shaft, and raise the oil stored in the lower portion of the airtight case, and wherein the oil raising cylinder comprises a plurality of protrusions disposed on a surface of the oil raising cylinder facing the stationary shaft.

2. The hermetic compressor of claim 1, wherein:

the oil raising cylinder comprises a hollow cylindrical shape.

3. The hermetic compressor of claim 2, wherein a cross-section of each of the plurality of protrusions comprises any one of a polygonal shape, a circular shape, a semicircular shape, or an elliptical shape.

4. The hermetic compressor of claim 1, wherein:

the oil raising cylinder comprises a hollow cylindrical shape, and a plurality of grooves are disposed on a surface of the oil raising cylinder facing the stationary shaft.

5. The hermetic compressor of claim 4, wherein a cross-section of each of the plurality of grooves comprises any one of a polygonal shape, a circular shape, a semicircular shape, or an elliptical shape.

6. The hermetic compressor of claim 1, wherein:

the oil raising cylinder comprises a hollow cylindrical shape, and a helical groove or a helical protrusion is disposed on a surface of the oil raising cylinder facing the stationary shaft.

7. The hermetic compressor of claim 1, wherein a surface of the oil raising cylinder facing the stationary shaft comprises a surface roughness configured to apply a drag force for raising the oil.

8. The hermetic compressor of claim 1, wherein at least two extending protrusions, comprising a length corresponding to a length of the oil raising cylinder, are disposed on a surface of the oil raising cylinder facing the cavity of the rotation shaft in a longitudinal direction of the oil raising cylinder.

9. The hermetic compressor of claim 1, wherein:

the oil raising cylinder comprises a hollow pipe shape, and a cross-section of the oil raising cylinder comprises a lobe shape.

10. The hermetic compressor of claim 1, wherein the oil raising cylinder is formed from an elastic sheet and comprises a cylindrical shape.

11. The hermetic compressor of claim 10, wherein the oil raising cylinder is fixed to the cavity of the rotation shaft by an elastic force of the elastic sheet.

12. The hermetic compressor of claim 1, wherein the oil raising cylinder is formed of a hollow circular pipe.

13. The hermetic compressor of claim 12, wherein the oil raising cylinder is fixed to the cavity of the rotation shaft by any one of press fitting, screwing, or bonding.

14. The hermetic compressor of claim 1, wherein a portion of the oil raising cylinder is exposed to an outside from a bottom end of the rotation shaft.

15. A hermetic compressor comprising:

an airtight case including a lower portion configured to store oil;

a frame disposed in the airtight case;

a compression mechanism disposed in the frame and configured to compress a refrigerant;

a motor mechanism including a stator fixed to the frame and a rotor configured to rotate inside the stator;

a rotation shaft coupled to the rotor and including a cavity at a lower portion of the rotation shaft, wherein the rotation shaft is configured to rotate together with the rotor and operate the compression mechanism;

a stationary shaft inserted into the cavity of the rotation shaft and fixed to the airtight case; and an oil raising cylinder fixed to the cavity of the rotation shaft, configured to surround the stationary shaft, and including a helical groove on a surface of the oil raising cylinder facing the stationary shaft, wherein the oil raising cylinder is configured to rotate integrally with the rotation shaft, move relative to the stationary shaft, and raise the oil stored in the lower portion of the airtight case, and wherein the oil raising cylinder comprises a plurality of protrusions disposed on a surface of the oil raising cylinder facing the stationary shaft.

16. The hermetic compressor of claim 15, wherein:

the stationary shaft comprises a cylindrical shape.

17. The hermetic compressor of claim 15, wherein:

the stationary shaft comprises a cylindrical shape, and a plurality of grooves are disposed on an outer circumferential surface of the stationary shaft.

18. The hermetic compressor of claim 15, wherein the stationary shaft comprises a columnar shape having a cross-section of a lobe shape.

19. The hermetic compressor of claim 1, wherein the compression mechanism includes:

a cylinder fixed to the frame, and a piston connected to the rotation shaft and configured to reciprocate inside the cylinder.

20. The hermetic compressor of claim 1, wherein the compression mechanism includes:

a fixed scroll fixed to the frame, and an orbiting scroll connected to the rotation shaft and configured to rotate with respect to the fixed scroll.

* * * * *